US008668186B1

(12) United States Patent
Wagner

(10) Patent No.: US 8,668,186 B1
(45) Date of Patent: Mar. 11, 2014

(54) DUMPSTER SCREEN AND METHOD OF USE THEREOF

(76) Inventor: Robert F. Wagner, Baraboo, WI (US)

( * ) Notice: Subject to any disclaimer, the term of this patent is extended or adjusted under 35 U.S.C. 154(b) by 750 days.

(21) Appl. No.: 12/783,622

(22) Filed: May 20, 2010

(51) Int. Cl.
*E04H 17/16* (2006.01)

(52) U.S. Cl.
USPC ..... 256/25

(58) Field of Classification Search
USPC ..... 256/1, 24, 25, 32; 160/188, 189; 292/219, 220, 228, 230, 231, 234, 236, 292/238; 119/452, 457, 472, 473, 481, 502, 119/504, 506, 507, 510, 513, 514, 515, 520, 119/522, 524, 735, 736, 737
See application file for complete search history.

(56) References Cited

U.S. PATENT DOCUMENTS

| | | | | |
|---|---|---|---|---|
| 3,812,999 | A * | 5/1974 | Joseph | 220/494 |
| 3,924,913 | A | 12/1975 | Cooper | |
| 4,091,857 | A | 5/1978 | Jacobs | |
| 5,299,782 | A | 4/1994 | Lambert | |
| 5,680,893 | A | 10/1997 | Neer | |
| D402,375 | S | 12/1998 | Cook | |
| 5,875,597 | A | 3/1999 | Gingrich et al. | |
| 6,261,207 | B1 | 7/2001 | Publicover et al. | |
| 6,575,435 | B1 * | 6/2003 | Kotzen | 256/24 |
| 6,978,576 | B2 | 12/2005 | Shirk | |
| D549,917 | S | 8/2007 | Kassigkeit | |
| 2006/0060310 | A1 | 3/2006 | Haugen | |

* cited by examiner

*Primary Examiner* — Michael P Ferguson
*Assistant Examiner* — Daniel Wiley
(74) *Attorney, Agent, or Firm* — Robert C. Montgomery; Montgomery Patent & Design

(57) ABSTRACT

A dumpster screen comprising a fenced enclosure around one (1) or more trash dumpsters commonly found by commercial establishments. The fence material is made of an outdoor weather-proof textile material supported on its vertical sides using fence posts and along its horizontal edges using cables. A front portion of the enclosure, typically accessed by trucks to empty the dumpsters, comprises a gate portion. This enables the incoming truck to lower its forks across the reinforced top of said gate and continue lowering it until it can remove the dumpster in the normal manner. After emptying, the dumpster is replaced in the same manner and the front barrier automatically returns to position.

6 Claims, 6 Drawing Sheets

DUMPSTER SCREEN AND METHOD OF USE THEREOF

RELATED APPLICATIONS

The present invention was first described in a notarized Official Record of Invention on Apr. 3, 2009, that is on file at the offices of Montgomery Patent and Design, LLC, the entire disclosures of which are incorporated herein by reference.

FIELD OF THE INVENTION

The present invention relates generally to trash disposal facilities, and in particular, to a dumpster enclosure adapted for quick access via a conventional waste collection truck forklift assembly.

BACKGROUND OF THE INVENTION

In many commercial and residential settings, trash collection is consolidated via conventional dumpsters prior to attendance by a local waste collection agency. Due to associated odors and other health concerns, dumpsters are generally located outdoors. The outdoor location further facilitates easy access by waste collection vehicles for lifting and emptying. However, trash receptacles such as dumpsters are generally considered to be unsightly and also to pose various health and safety hazards. As a result, most such receptacles are housed inside a fencing assembly or other enclosure in order to provide a visual screening and physical barrier between the waste materials and people in the vicinity.

While such enclosures indubitably serve their purposes, enclosure of dumpsters inhibits the efficiency with which waste collection vehicles and the like are able to access the dumpsters for emptying. General practice is for a driver or operator of such a vehicle to park and exit the vehicle, open the dumpster enclosure, lift and empty the dumpster, replace the dumpster, and again exit the vehicle to close and secure the enclosure. While individual dumpsters are often only accessed on a periodic basis, repeated performance of these actions during a daily route adds a significant amount of time and physical exertion to the routine of the operator.

Various attempts have been made to provide waste receptacle enclosures. Examples of these attempts can be seen by reference to several U.S. patents. U.S. Pat. No. 3,924,913, issued in the name of Cooper, describes a garbage can enclosure device which provides a screened enclosure for conventional outdoor trash cans.

U.S. Pat. No. 6,978,576, issued in the name of Shirk, describes a gate assembly which provides a durable and shock absorbent gated enclosure for a conventional dumpster.

Additionally, ornamental designs for a waste receptacle enclosure exist, particularly U.S. Pat. Nos. D 402,375 and D 549,917. However, none of these designs are similar to the present invention.

While these devices fulfill their respective, particular objectives, each of these references suffer from one (1) or more of the aforementioned disadvantages. Many existing enclosures are difficult and time consuming to access for an operator of a conventional waste collection vehicle. Also, many existing enclosures require a user to exit a vehicle in order to selectively access the enclosed structure. Furthermore, many existing enclosures such as conventional fencing assemblies do not provide a desirable level of aesthetic screening to an enclosed waste receptacle. Accordingly, there exists a need for a dumpster enclosure without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for an enclosure suitable for outdoor use with a conventional dumpster which provides features of aesthetic screening and ease of access via a conventional existing waste collection vehicle. Thus, the object of the present invention is to solve the aforementioned disadvantages and provide for this need.

To achieve the above objectives, it is an object of the present invention to provide a dumpster screen which conceals an existing conventional trash receptacle.

Another object of the present invention is to allow a conventional trash receptacle with front loading sleeves to be accessed for loading and emptying via a conventional trash collection vehicle.

Yet still another object of the present invention is to enclose a trash receptacle on four (4) sides. The apparatus comprises a rectangular structure further comprised of a plurality of pipe frame sections, a gate portion, a moveable rod, and a plurality of screening sections.

Yet still another object of the present invention is to provide a gate on a front portion which can be lowered and locked via downward force provided by loading arms of an existing trash collection vehicle. This is accomplished via a movable rod which is attached at an upper location to inner side portions between front side posts of the frame.

Yet still another object of the present invention is to automatically return to an original concealing position after a trash collection vehicle removes and empties a contained trash receptacle.

Yet still another object of the present invention is to allow vertical motioning of the movable rod via "U"-shaped channels positioned vertically to the front posts of the frame. The posts further comprises integral pulley assemblies including steel cables, pulley axles, counter weights, pulley fasteners, and the like which provide a means for support the movable rod and returning it to an initial position upon removal of a trash collection vehicle.

Yet still another object of the present invention is to provide selectable decorative screening of a contained trash receptacle via the screening portions. The screening portions are constructed of a durable weatherproof material for outdoor use.

Yet still another object of the present invention is to attach the apparatus to a level ground surface via a plurality of rectangular feet which support the apparatus vertically.

Yet still another object of the present invention is to provide a method of utilizing the device that provides a unique means of positioning the structure around an existing trash receptacle in order to provide a concealing function, utilizing an existing trash collection vehicle with conventional loading arms in order to depress the movable rod for access to the contained receptacle, lifting and emptying the receptacle in a conventional manner, replacing the receptacle, and automatically returning the front gate to a closed position upon removal of the collection vehicle in order to return the apparatus to a concealing configuration without need for leaving the vehicle.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
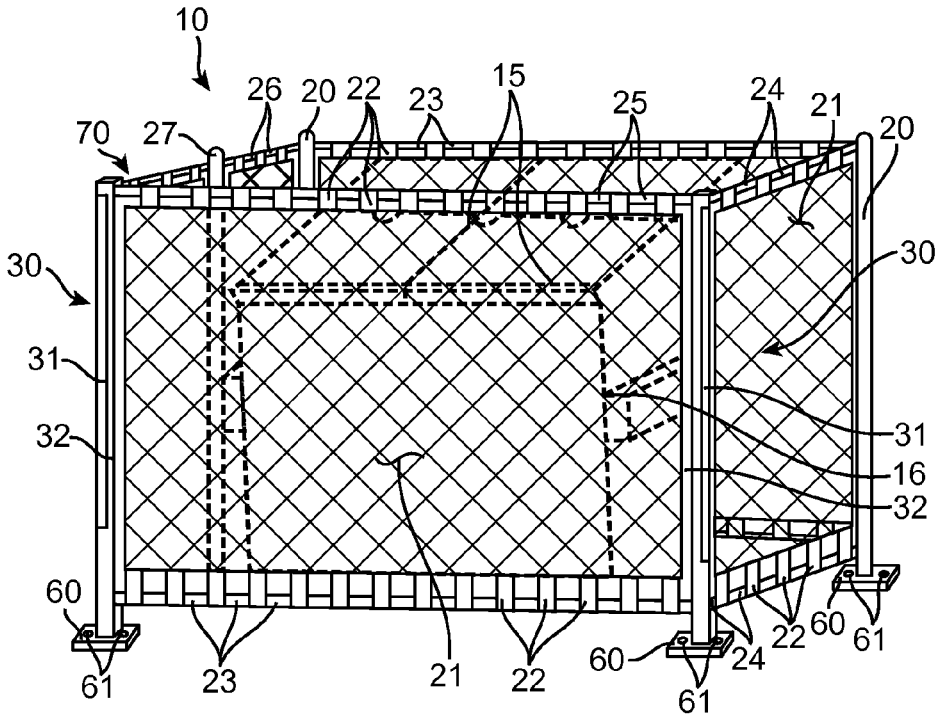
FIG. 1 is a perspective view of a dumpster screen 10 depicting a closed state, according to a preferred embodiment of the present invention.

10 dumpster screen
15 trash receptacle
16 sleeve
18 frame
20 rear corner pipe
21 screen
22 tab
23 first rod
24 second rod
25 movable rod
26 third rod
27 side pipe
30 gate
31 channel
32 post
33 pulley
34 pulley access panel
35 cable
36 spring
37 spring access panel
38 first counter weight
39 second counter weight
40 diverter gate
50 first counter weight fastener
52 locking arm
60 foot
61 foot fastener
70 side entrance
71 elastic cord
72 cord spring
73 cord hook
80 first pivot
81 second pivot
82 spring attachment point
83 spring fixed point
90 pulley axle
91 pulley fastener

DETAILED DESCRIPTION OF THE PREFERRED EMBODIMENT

The best mode for carrying out the invention is presented in terms of its preferred embodiment, herein depicted within FIGS. 1 through 7. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a dumpster screen (herein described as the "apparatus") 10, which provides a means for concealing an existing conventional trash receptacle 15, yet allowing said trash receptacle 15 to be accessed for loading and emptying thereof. Said apparatus 10 preferably utilized with conventional front end trash receptacles 15 which comprise a pair of front sleeves 16, thereby allowing a conventional front loading garbage truck to utilize said sleeves 16 for conventional emptying. Other trash receptacles 15 may be utilized without limiting the functions of the apparatus 10. Said apparatus 10 comprises a rectangular shape, thereby enclosing the trash receptacle 15 thereon four (4) sides. Said apparatus 10 also comprises a pair of rear corner pipes 20, a plurality of screening 21, a plurality of first rods 23, a movable rod 25, a pair of third pipes 26, a pair of side pipes 27, a gate portion 30, a pair of pulleys 33, a first counter weight 38, a second counter weight 39, and a side entrance 70. Said apparatus 10 allows the areas around trash receptacle 15 to be contained for security and aesthetic reasons.

Figure 2:
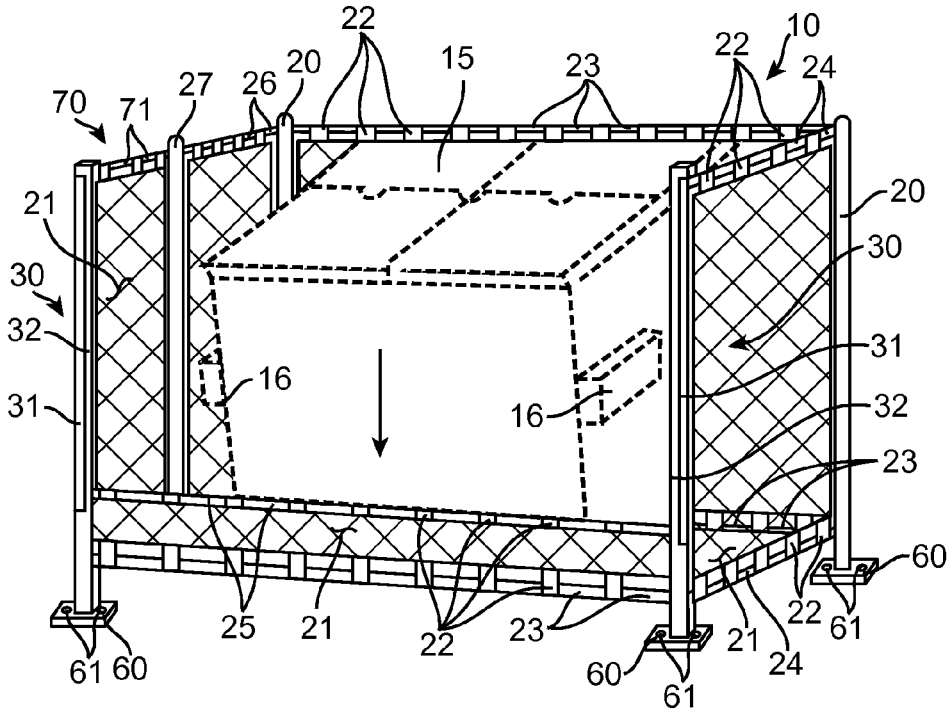
FIG. 2 is a perspective view of the dumpster screen 10 depicting an open state, according to a preferred embodiment of the present invention.

Referring now to FIG. 1, a perspective view of the apparatus 10 depicting a closed state and FIG. 2, a perspective view of the apparatus 10 depicting an open state, according to the preferred embodiment of the present invention, are disclosed. In use, the apparatus 10 is positioned on a level ground surface encompassing an existing trash receptacle 15, thereby concealing said trash receptacle 15. A gate 30 (also see FIG. 4 through 6) located on a front portion of the apparatus 10 is lowered and locked via a downward force provided by a pair of loading arms thereon the front loading garbage truck. The garbage truck then removes the trash receptacle 15 for emptying in a conventional manner. When finished the garbage truck replaces the trash receptacle 15 via the pair of loading arms 16 to its original position which also unlocks the gate 30, thereby positioning the apparatus 10 to an original concealed position.

Figure 3:
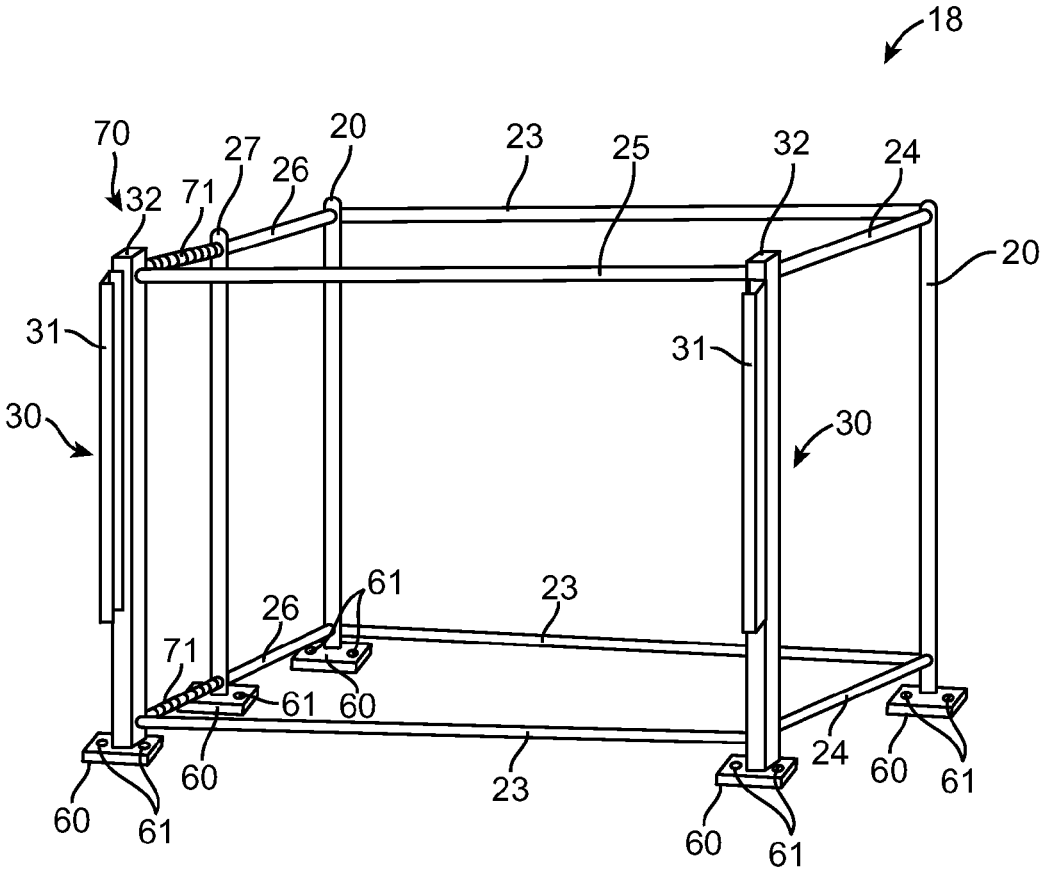
FIG. 3 is a perspective view of the dumpster screen 10 depicting a frame 18, according to a preferred embodiment of the present invention.

Referring now to FIG. 3, a perspective view of the apparatus 10 depicting a frame 18, according to the preferred embodiment of the present invention, is disclosed. The apparatus 10 is depicted without a plurality of screening 21 for illustration purposes only; it is known that screening 21 is to be incorporated into the final design for concealing of the trash receptacle 15. The apparatus 10 comprises a rectangular frame 18 which also comprises a pair of rear corner pipes 20, a plurality of first rods 23, a pair of second rods 24, a movable rod 25, a pair of third rods 26, a pair of posts 32, and a plurality of feet 60. A pair of tubular rear corner pipes 20 is positioned vertically at rear corners of the frame 18. A tubular first rod 23 is horizontally positioned at a ninety degree (90°) angle from the rear corner pipes 20 at an upper and a lower location, thereby supporting said rear corner pipes 20. The rear corner pipes 20 located at the rear corners of the apparatus 10 and the first rods 23 located perpendicular to said rear corner pipes 20 create a rear panel structure of the frame 18. The length of the first rod 23 located between the pair of rear corner pipes 20 which are located at the rear portion of the apparatus 10 is wider than that of the trash receptacle 15, thereby allowing said trash receptacle 15 to be located therein. The first rods 23 also provide a suspending means to screening 21, thereby attaching said screening 21 thereto the first rods 23 (see herein below). The rear corner pipes 20 are fabricated from conventional steel piping preferably comprising a diameter of two (2) inches and comprising a height which is an appropriate dimension to conceal the trash receptacle 15, yet other dimensions may be utilized without limiting the functions of the apparatus 10. The first rods 23 and rear corner pipes 20 are fabricated from a steel material, yet other durable materials may be utilized without limiting the functions of the apparatus 10.

A side portion of the frame 18 is created via positioning a pair of tubular second rods 24 at an upper and a lower position perpendicular to a rear corner pipe 20. Distal end portions of the second rods 24 are attached to the rear corner pipe 20 with fastening means such as, but not limited to: welding, interference fitting, or the like. Proximal end portions of the second rods 24 are connected to a rectangular post 32 located parallel to the rear pipe 20 via a fastening means which is similar as abovementioned. Said post 32 is located at a front portion of the apparatus 10 and is an integral element of a gate 30 (see FIG. 4 through 6). The addition of the pair of second rods 24 to the rear corner pipe 20 and post 32 provides a side panel to the frame 18 and also provide a suspending means to screening 21, thereby attaching said screening 21 thereto the second rods 24 (see herein below). The second rods 24 are appropriate dimensions to conceal the width of the trash receptacle 15 and are fabricated from steel, yet other materials may be utilized without limiting the functions of the apparatus 10.

Another side portion of the frame 18 is created via positioning a pair of tubular third rods 26 at an upper and a lower position perpendicular from the other rear corner pipe 20. The third rods 26 are then attached to a tubular side pipe 27, thereby securing said third rods 26 in a horizontal position. Attached to an upper and lower opposite portion of the side pipe 27 are a pair of elastic cords 71 which are further attached to a rectangular post 32, thereby creating a side entrance 70 (see FIG. 7). The side pipe 27 is located at an intermediate position between the rear corner pipe 20 and the post 32. The third rods 26 and elastic cords 71 also provide a suspending means to screening 21, thereby attaching said screening 21 thereto the third rods 26 (see herein below).

The post 32 is parallel to the opposite post 32 and rear corner pipe 20. The posts 32 are separated at an appropriate width that which corresponds to the width of the first rods 23 via a tubular movable rod 25 and another first rod 23. The movable rod 25 is positioned at an upper location between the posts 32 and provides an upward and downward motion of gate 30 (also see FIGS. 4 through 6) and an attachment means to screening 21. The movable rod 25 is attached to inner side portions of the posts 32 via an internal pulley 33 (see FIG. 4 through 6). The first rod 23 is positioned at a lower position between the posts 32 and attached thereto with fastening means such as, but not limited to: welding, interference fitting, or the like, thereby creating a structurally sound frame 18. The posts 32 are fabricated from conventional steel rectangular pipe with a diameter of five (5) inches, yet other materials and dimensions may be utilized without limiting the functions of the apparatus 10. The movable rod 25 is fabricated from conventional steel pipe with a diameter of one-and-a-half (1½) inches, yet other materials and dimensions may be utilized without limiting the functions of the apparatus 10.

The frame 18 is attached to a level ground surface via a plurality of rectangular feet 60, thereby supporting the apparatus 10 vertically. The feet 60 are preferably attached via conventional welding techniques thereto a bottom distal portion of the rear corners pipes 20, the side pipe 27, and the posts 32. Said feet 60 are then fastened to the ground surface therewith foot fasteners 61 which are comprised of conventional fasteners such as, but not limited to: bolts, stakes, or the like. The feet 60 are fabricated from steel, yet other materials may be utilized without limiting the functions of the apparatus 10.

The frame 18 of the apparatus 10 comprises a plurality of screening 21 (also see FIGS. 1, 2, 4, and 7) as abovementioned, thereby providing a concealing means to the trash receptacle 15. Said screen 21 may be fabricated from a variety of outdoor weatherproof materials such as, but not limited to: wire mesh, nylon, canvas, or the like. The screening 21 is attached to the first rods 23, the second rods 24, the movable rod 25, the third rods 26, and the elastic cords 71 via a plurality of tabs 22. Said tabs 22 are preferably attached to the screening via conventional sewing techniques at equidistant intervals and attached to an appropriate horizontal device 23, 24, 25, 26, 71 via fastening means such as, but not limited to: hook-and-loop fasteners, adhesive, sewing techniques, or the like. Said tabs 22 are fabricated from a material such as, but not limited to: canvas, plastic, metal, or the like. The screening 21 may also comprise indicia which may provide script or logos based upon a user's preference and may include images such as, but not limited to: sports names/logos, personal names, symbols, pictures, and the like to further customize and personalize the apparatus 10 further comprising a variety of colors and patterns.

Figure 4:
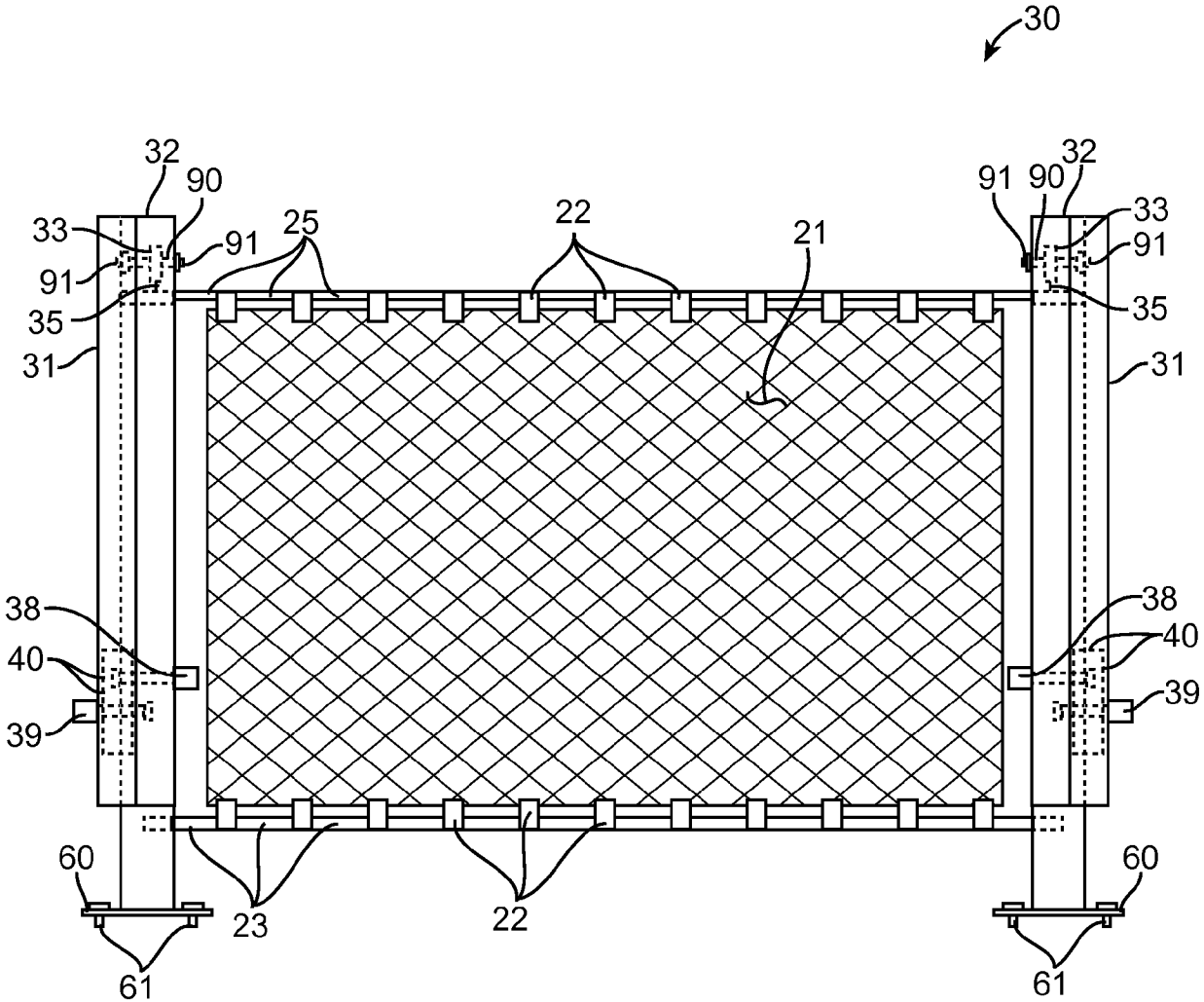
FIG. 4 is a front view of a gate 30, according to a preferred embodiment of the present invention.

Referring now to FIG. 4, a front view of a gate 30, according to the preferred embodiment of the present invention, is disclosed. The apparatus 10 comprises a gate 30, thereby providing access to the trash receptacle 15. The gate 30 comprises a pair of posts 32 as abovementioned thereon each front corners of the apparatus 10. Each post 32 comprises a channel 31, a of pulley 33, a plurality of cable 35, a spring 36, a first counter weight 38, a second counter weight 39, a diverter gate 40, and a locking arm 52 (also see FIGS. 5 and 6). Said gate 30 allows the garbage truck to lower its loading arms across the movable rod 25 and continue lowering until the trash receptacle 15 can be removed in a normal manner. After emptying, the trash receptacle 15 is replaced in the same normal manner and the gate 30 automatically returns to an original concealing position.

Figure 5:
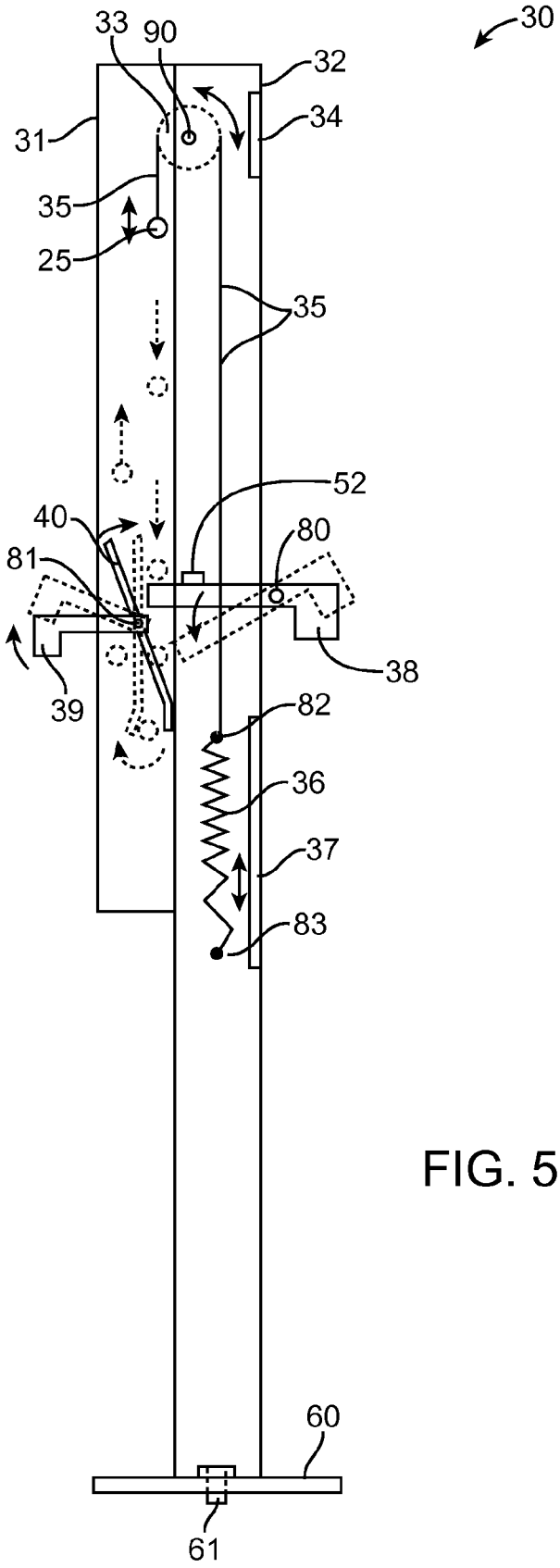
FIG. 5 is a side elevation view of the gate 30, according to a preferred embodiment of the present invention.
Figure 6:
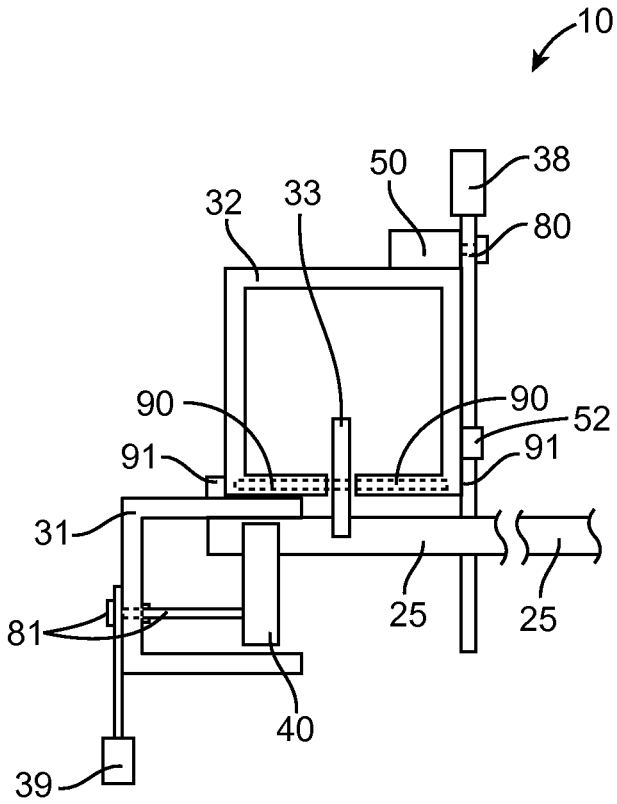
FIG. 6 is a top view of a single post portion 32 of the gate 30, according to a preferred embodiment of the present invention; and, FIG. 7 is a front view of a side entrance 70, according to a preferred embodiment of the present invention.

Referring now to FIG. 5, a side view of the gate 30 and FIG. 6, a top view of the gate 30, according to the preferred embodiment of the present invention, are disclosed. A "U"-shaped channel 31 is positioned vertically to each post 32 and attached to a front portion of each said post 32, thereby providing a means for the movable rod 25 to descend and rise. Said channel 31 is preferably a four (4) inch steel channel, yet other devices and materials may be incorporated without limiting the features of the apparatus 10. Said channel 31 is attached to the post 31 via conventional welding techniques, yet other fastening means may be provided without limiting the functions of the apparatus 10.

The gate 30 lowers and rises via a pair of circular pulleys 33. A pulley 33 is located at an upper location internally within each post 32 and corresponding channel 31. A steel cable 35 is wound around the pulley 33 and attached at a lower location to a spring 36 at a spring attachment point 82, thereby allowing the spring 36 to retract to decrease the length of the cable 35 and extend to increase the length of the cable 35. An opposite end portion of the spring 36 is fixed within the post 32 at a spring fixed point 83. A distal portion of each cable 35 is attached to the movable rod 25, thereby concurrently lowering or raising said movable rod 25 as the length of the cable 35 is increased or decreased, respectively. Each pulley 33 is attached to the post 32 via a pulley axle 90 fastened via conventional pulley fasteners 91 which allow said pulleys 33 to rotate freely in a conventional manner. Each post 32 comprises a pulley access panel 34 thereon a rear top portion and a spring access panel 37 thereon a rear lower portion, thereby providing access to the pulley 33 and spring 36, respectively, for routine maintenance.

As the movable rod 25 is lowered from a downward force applied via the loading arms on the garbage truck the cable 35 is extended downwardly and the spring 36 is extended upwardly. The movable rod 25 travels further downward to come in contact with an "L"-shaped first counter weight 38 thereon each distal end portion, thereby causing said first counter weight 38 to pivot in a downward motion. Said first counter weight 38 is attached to an intermediate outer surface thereon the post 32 via first pivot 80 to a first counter weight fastener 50 such as, but not limited to: a shoulder bolt, a bushing and pin, a bracket, or the like. Said first counter weight 38 is positioned at an appropriate location which will allow for proper pivoting of said first counter weight 38 to enable the movable rod 25 to move beyond. The first counter weight 38 is an appropriate weight to allow for correct pivoting once contacted by the movable rod 25. A rectangular locking arm 52 is positioned above the resting position of the first counter weight 38, thereby impeding the upward motion of said first counter weight 38. The locking arm 52 is preferably a steel device welded to the post 32.

Once below the first counter weight 38 the movable rod 25 is locked into a downward position between said first counter weight 38 and a diverter gate 40, thereby stopping the movement of the movable rod 25 and positioning the gate 30 in an open state (see FIG. 2). The diverter gate 40 is comprised of a rectangular steel plate slightly smaller than the dimensions of the channel 31, thereby enabling insertion therein. In use, this is the moment when the loading arms thereon the garbage trucks are inserted into the first sleeves 16 thereon the trash receptacle 15 for conventional emptying. Once the trash receptacle 15 is placed back within the apparatus 10 the loading arms come in contact with the movable rod 25, thereby allowing an "L"-shaped second counter weight 39 to pivot upwardly. This interaction also allows the internal diverter gate 40 to correspondingly rotate counterclockwise, thereby enabling the movable rod 25 to travel further downwardly and release itself from the diverter gate 40 further ascending the movable rod 25 to its original upward closed position (see FIG. 1). The second counter weight 39 is attached to a side portion of the channel 31 via a second pivot 81 which is comprised of conventional a shoulder bolt, a bushing and pin, a bracket, or the like, yet other fastening means may be utilized without utilizing the functions of the apparatus 10. The second counter weight 39 and the diverter gate 40 pivot via a second pivot 81, thereby attaching said second counter weight 39 and diverter gate 40 together and enabling a simultaneous counterclockwise rotation. The second pivot 81 preferably comprises a bolt and keyhole arrangement which would enable an attachment of the second counter weight 39 and the diverter gate 40 and provide the necessary synchronized pivoting means, yet other fastening and pivoting means may be utilized without limiting the functions of the apparatus 10. The second counter weight 39 is an appropriate weight to allow for correct rotation thereof itself and the diverter gate 40.

Figure 7:
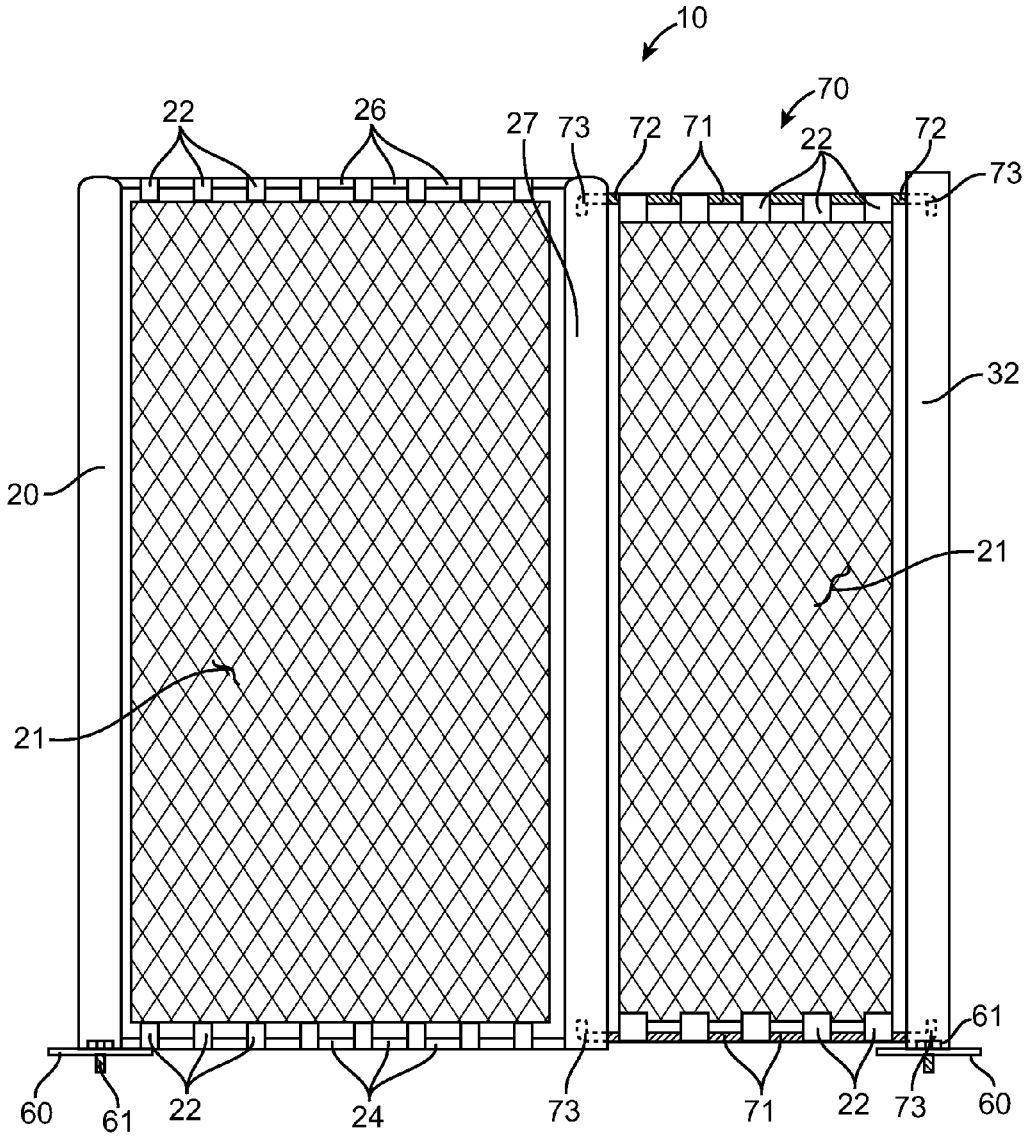

Referring now to FIG. 7, a front view of a side entrance 70, according to the preferred embodiment of the present invention, is disclosed. The apparatus 10 comprises a side entrance 70, thereby enabling a person to access the trash receptacle 15 for filling in a conventional manner. The upper and lower horizontal portions of the side entrance 70 each comprises an elastic cord 71, a pair of cord springs 72, and a pair of cord hooks 73. The tabs 22 attached to the screen 21 are further attached thereon each elastic cord 71, thereby suspending said screen thereon. Cord springs 72 encompass each end portions of the elastic cords 71 which are further attached to corresponding cord hooks 73, thereby providing a fastening means to the post 32 and side pipe 27. The cord springs 72 provide a tensioning means to the elastic cord 71, thereby securing the screen 21 thereon. The cord hooks 73 provide an attaching means to the corresponding post 32 and side pipe 27. The cord hook 73 may attached to the post 32 and side pipe 27 via means such as, but not limited to: engaging an aperture, engaging an eye screw, or the like. The elastic cord 71 is preferably a conventional cotton or nylon cord which comprises a stretchable core, yet other devices may be utilized without limiting the functions of the apparatus 10.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1 through 7.

The method of installing and utilizing the apparatus 10 may be achieved by performing the following steps: acquiring the apparatus 10; lowering the gate 30, thereby forcing the movable rod 25 downwardly thereto descend the cable 35 thereon the pulleys 33 and ascend the springs 36; locking the gate 30, thereby pivoting the first counter weight 38 trapping the movable rod 25 between the first counter weight 38 and the diverter gate 40; inserting a trash receptacle 15 therein the frame 18; raising the gate 30, thereby forcing the movable rod 25 downwardly to pivot the second counter weight 39 which simultaneously pivots the diverter gate 40 enabling the movable rod 25 to travel upwardly to its original position; utilizing the side entrance to fill the trash receptacle 15 with desired items, thereby removing the cord hook 73 from the corresponding post 32 and side pipe 27 and enabling the screening 21 to collapse and entering the apparatus 10; replacing the cord hooks 73 as desired; allowing a pair of loading arms thereon a garbage truck to lower the gate 30 in a manner as abovementioned for emptying of the trash receptacle 15 and replacing as desired; and, allowing the apparatus 10 to visually cover and physically protect trash receptacle 15 without the disadvantages of conventional gates in a manner which is quick and effective.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A dumpster screen for concealing an existing conventional trash receptacle while allowing the trash receptacle to be accessed for loading and emptying, said dumpster screen comprising a frame further comprising:

a plurality of screens connected to said frame and adapted to conceal the trash receptacle; and, a gate located on a front portion of said frame;

a plurality of rear corner pipes located vertically at rear corners of said frame;

a plurality of first rods horizontally located at upper and lower portions of said frame, said first rods being positioned at a ninety degree angle from said rear corner pipes and thereby suspending said screens above the ground surface;

a plurality of second rods each perpendicularly and fixedly attached at upper and lower portions of said rear corner pipes;

a plurality of third rods located at said upper and lower portions of said frame, said third rods being positioned perpendicular from one of said rear corner pipes;

a plurality of posts located at said front portion of said frame;

a movable rod positioned at an upper location between said posts thereby providing upward and downward motion of said gate, wherein said movable rod is attached to inner side portions of said posts; and, a side pipe located at an intermediate portion of said frame, said side pipe being positioned between said one rear corner pipe and one of said posts;

wherein said gate is adapted to be automatically displaced between a lowered closed position and a raised open state when the trash receptacle is lowered and lifted from within said frame respectively, wherein said gate further comprises:

a U-shaped channel positioned vertically to said one post and attached to a front portion of said one post respectively;

a pulley located at an upper location internally within said one post and said channel respectively;

a cable having a distal portion attached to said movable rod and a proximal portion;

a spring, having a first end fixed within said one post and a spring attachment point at a second, said spring attachment point attached to said cable proximal portion;

an L-shaped first counter weight attached to an intermediate outer surface of said one post via a first pivot to a first counter weight fastener;

an L-shaped second counter weight attached to a side portion of said channel;

a diverter gate inserted within said channel;

a second pivot attaching said second counter weight and said diverter gate to said channel; and, a locking arm affixed to said one post and positioned above a resting position of said first counter weight;

wherein when said wherein said second rods are fixedly mated to said posts which are located parallel to said rear corner pipes respectively;

wherein said side pipe is attached to said third rods thereby securing said third rods in a horizontal position;

wherein said posts are separated at a width of said first rods via said movable rod and one of said first rods;

wherein said movable rod travels downwardly and contacts said first counter weight thereby causing said first counter weight to pivot about a first pivot in an upward motion;

wherein said locking arm impedes upward motion of said first counter weight;

wherein said movable rod is locked into a downward position between said first counter weight and said diverter gate thereby stopping movement of said movable rod and positioning said gate in said open state;

wherein said second counter weight pivots upwardly when said movable rod is adapted to contact the trash receptacle as the trash receptacle is lowered into said frame;

whereby when a force is applied to said movable rod, said diverter gate rotates counterclockwise and said second counter weight pivots upwardly so that said movable rod travels downwardly and is released from said diverter gate, thereby causing said movable rod to ascend to an original upward closed position; and, wherein said second counter weight and said diverter gate simultaneously pivot at a counter clockwise rotation; and, wherein another one of said first rods is positioned at a lower portion between said posts.

2. The dumpster screen of claim 1, wherein said movable rod descends and rises within said channel;

wherein said cable is wound around said pulley and attached to said spring such that said spring retracts and extends a length of said cable respectively, thereby enabling said cable to concurrently lower and raise said movable rod; and, wherein, as said movable rod is lowered, said cable is extended downwardly and said spring is extended upwardly.

3. The dumpster screen of claim 1, wherein said frame further comprises: a side entrance spaced from said gate, said side entrance comprising:

an elastic cord;

a plurality of cord springs connected to said elastic cord and thereby tensioning said elastic cord; and, a pair of cord hooks attached to said posts and side pipes.

4. A dumpster screen for concealing an existing conventional trash receptacle while allowing the trash receptacle to be accessed for loading and emptying, said dumpster screen comprising a frame statically affixed to a ground surface and comprising:

a plurality of screens connected to said frame and adapted to conceal the trash receptacle;

a gate located on a front portion of said frame;

a plurality of rear corner pipes located vertically at rear corners of said frame;

a plurality of first rods horizontally located at upper and lower portions of said frame, said first rods being positioned at a ninety degree angle from said rear corner pipes and thereby suspending said screens above the ground surface;

a plurality of second rods each perpendicularly and fixedly attached at upper and lower portions of said rear corner pipes;

a plurality of third rods located at said upper and lower portions of said frame, said third rods being positioned perpendicular from one of said rear corner pipes;

a plurality of posts located at said front portion of said frame;

a movable rod positioned at an upper location between said posts thereby providing upward and downward motion of said gate, wherein said movable rod is attached to inner side portions of said posts;

a side pipe located at an intermediate portion of said frame, said side pipe being positioned between said one rear corner pipe and one of said posts; and, a side entrance spaced from said gate;

wherein said gate is adapted to be automatically displaced between a lowered closed position and a raised open state when the trash receptacle is lowered and lifted from within said frame respectively, said gate further comprising:

a U-shaped channel positioned vertically to said one post and attached to a front portion of said one post respectively;

a pulley located at an upper location internally within said one post and said channel respectively;

a cable having a distal portion attached to said movable rod and a proximal portion;

a spring, having a first end fixed within said one post and a spring attachment point at a second, said spring attachment point attached to said cable proximal portion;

an L-shaped first counter weight attached to an intermediate outer surface of said one post via a first pivot to a first counter weight fastener;

an L-shaped second counter weight attached to a side portion of said channel;

a diverter gate inserted within said channel;

a second pivot attaching said second counter weight and said diverter gate to said channel; and, a locking arm affixed to said one post and positioned above a resting position of said first counter weight;

wherein said second rods are fixedly mated to said posts which are located parallel to said rear corner pipes respectively;

wherein said side pipe is attached to said third rods thereby securing said third rods in a horizontal position;

wherein said posts are separated at a width of said first rods via said movable rod and one of said first rods;

wherein said movable rod travels downwardly and contacts said first counter weight thereby causing said first counter weight to pivot about a first pivot in an upward motion;

wherein said locking arm impedes upward motion of said first counter weight;

wherein said movable rod is locked into a downward position between said first counter weight and said diverter gate thereby stopping movement of said movable rod and positioning said gate in said open state;

wherein said second counter weight pivots upwardly when said movable rod is adapted to contact the trash receptacle as the trash receptacle is lowered into said frame;

whereby when a force is applied to said movable rod, said diverter gate rotates counterclockwise and said second counter weight pivots upwardly so that said movable rod travels downwardly and is released from said diverter gate, thereby causing said movable rod to ascend to an original upward closed position; and, wherein said second counter weight and said diverter gate simultaneously pivot at a counter clockwise rotation; and, wherein another one of said first rods is positioned at a lower portion between said posts.

5. The dumpster screen of claim 4, wherein said movable rod descends and rises within said channel;

wherein said cable is wound around said pulley and attached to said spring such that said spring retracts and extends a length of said cable respectively, thereby enabling said cable to concurrently lower and raise said movable rod; and, wherein, as said movable rod is lowered, said cable is extended downwardly and said spring is extended upwardly.

6. The dumpster screen of claim 4, wherein said side entrance comprises:

an elastic cord;

a plurality of cord springs connected to said elastic cord and thereby tensioning said elastic cord; and, a pair of cord hooks attached to said posts and side pipes.

* * * * *